US006872170B2

(12) United States Patent
Kuo

(10) Patent No.: US 6,872,170 B2
(45) Date of Patent: Mar. 29, 2005

(54) MULTI-FUNCTION PHYSICAL TRAINING MACHINE

(76) Inventor: Johnson Kuo, 11FL.-1C, No. 342, Keelung Rd., Sec. 1, Taipei (TW)

( * ) Notice: Subject to any disclaimer, the term of this patent is extended or adjusted under 35 U.S.C. 154(b) by 393 days.

(21) Appl. No.: 10/224,455

(22) Filed: Aug. 21, 2002

(65) Prior Publication Data

US 2004/0002412 A1 Jan. 1, 2004

(30) Foreign Application Priority Data

Jun. 26, 2002 (TW) ..... 91209629 U

(51) Int. Cl.[7] ..... A63B 21/02

(52) U.S. Cl. ..... 482/71; 482/123; 482/130

(58) Field of Search ..... 482/123, 71, 72, 482/124, 130, 142, 137, 133, 135, 121, 122; 21/690, 676, 191

(56) References Cited

U.S. PATENT DOCUMENTS 5,722,917 A * 3/1998 Olschansky et al. ..... 482/72
6,152,866 A * 11/2000 Kuo ..... 482/142
6,533,710 B2 * 3/2003 Lin et al. ..... 482/123

* cited by examiner

*Primary Examiner*—Jerome Donnelly
(74) *Attorney, Agent, or Firm*—Browdy and Neimark, P.L.L.C.

(57) ABSTRACT

A multi-function physical training machine comprises a base frame and coupling units mounted on the base frame for the installation of at least one cord assembly which has two elastic cords. A T-shaped bar is pivoted on the base frame to be turned in a predetermined range. First resistance members are installed on the T-shaped bar to provide the T-shaped bar a loading when being turned. A seat assembly is mounted on the base frame and is pivotally connected with a training bar assembly such that the training bar assembly can be turned in a predetermined range. Second resistance members are installed on the training bar assembly to provide the training bar assembly a loading when being turned.

3 Claims, 12 Drawing Sheets

MULTI-FUNCTION PHYSICAL TRAINING MACHINE

FIELD OF THE INVENTION

The present invention relates generally to a physical training machine, and more particularly to a multifunctional physical training machine, which provides plenty of exercise modes.

BACKGROUND OF THE INVENTION

In modern life, people pay more attention to health and body building. Some people go to gymnasium for physical training and some people like to take exercise at home. In exercise, people will sweat to get metabolism quickly, and more particularly, it will loose weight.

But more and more people like to do exercise at home, so simply constructed physical training machines were provided in the market and they are popular to customers. They have small size to facilitate store them at home.

Most of the simply constructed physical training machines only have one exercise mode to train a specific muscle. User has to buy another type of training machine to exercise another muscle. That will cost consumer very much to buy these training machines, and most of all, user will get boring with the single mode of exercise after having done exercise on the training machine for a few time.

SUMMARY OF THE INVENTION

The primary objective of the present invention is to provide a multi-function physical training machine, which has plenty of exercise modes to train the various muscles.

The secondary objective of the present invention is to provide a multi-function physical training machine, which can be folded to store it.

According to the objectives of the invention, a multi-function physical training machine comprises a base frame having a front side and a rear side. A supporting bar is pivotally mounted on the front side of the base frame. A plurality of coupling units are respectively mounted on left and right sides of the front and rear sides of the base frame. At least a cord assembly has two elastic cords installed on said coupling units respectively and two holding devices respectively connected to said elastic cords. A T-shaped bar is pivoted on said base frame in front of the supporting bar to be turned in a predetermined range. At least a first resistance member is installed on said T-shaped bar to provide said T-shaped bar a loading when it is turned. A seat assembly has a seat base provided at an end thereof with a connecting board which is pivoted on the base frame, a pad member mounted on the other end of the seat base, and a side tube mounted on the seat base below the pad member. A training bar assembly has a first shaft and a second shaft engaged with said first shaft. Wherein said second shaft is engaged with said side tube on said seat base for said training bar assembly can be turned in a predetermined range and said second shaft is provided with a connecting shaft. At least a second resistance member is installed on said training bar assembly to provide said training bar assembly a loading when being turned.

DETAIL DESCRIPTION OF THE INVENTION

Figure 1:
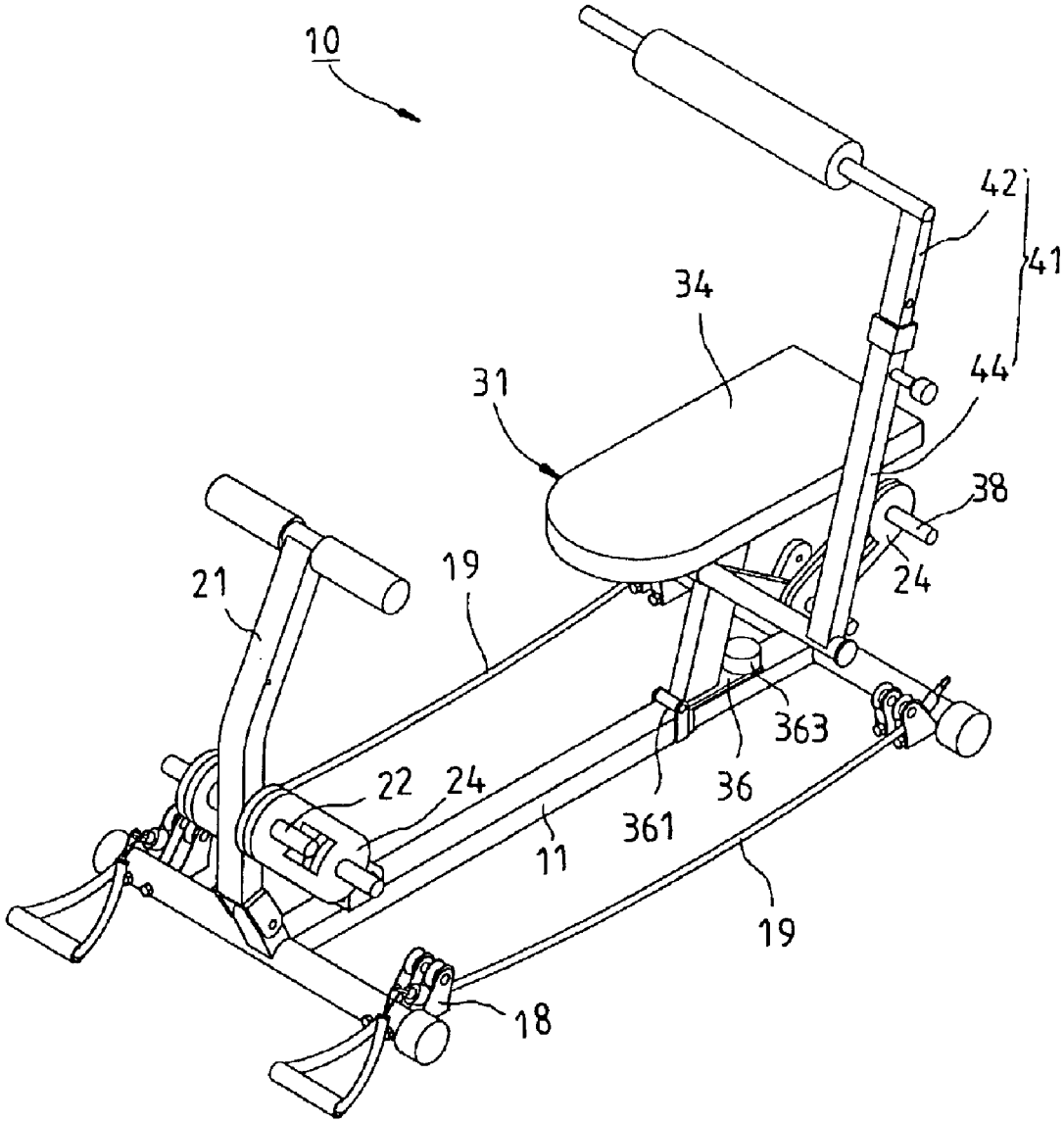
FIG. 1 is a perspective view of a preferred embodiment of the present invention.
Figure 2:
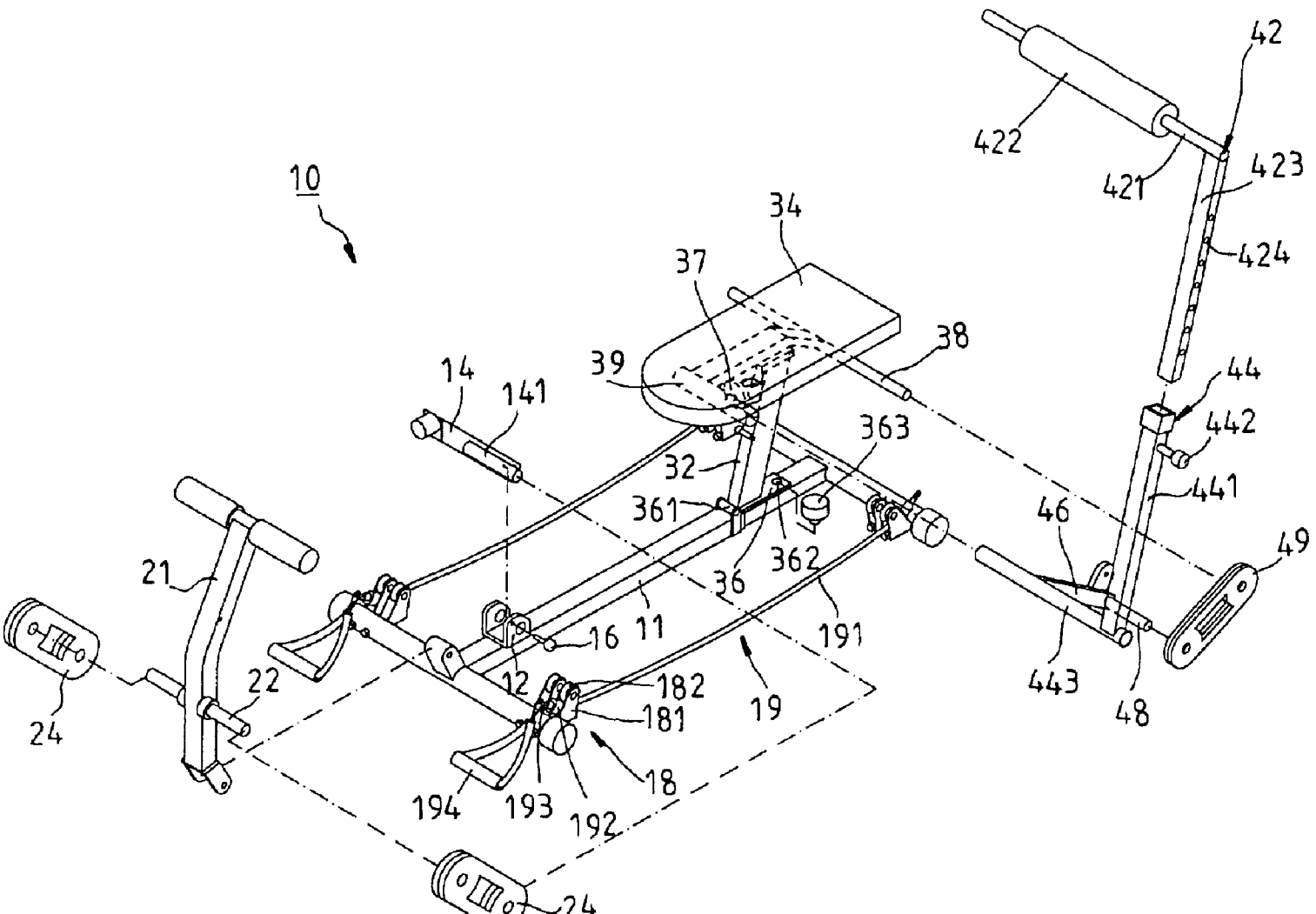
FIG. 2 is an exploded view of the preferred embodiment of the present invention.

Please refer to FIG. 1 and FIG. 2, a multi-function physical training machine 10 of a preferred embodiment of the present invention comprises a base frame 11, a pull cord assembly 19 having two elastic cords 191, a T-shaped bar 21, a seat assembly 31 and a training bar assembly 41.

The base frame 11 is composed of a first base bar and two second base bars having their midsections respectively coupled with the opposite ends of the first base bar. The base frame 11 is provided with a pivot connector 12 at the first base bar. A supporting bar 14 is provided with two first transverse bars 141 respectively outwardly extending from the opposed lateral sides of the supporting bar 14 at midsection thereof. The supporting bar 14 has an end thereof pivoted on the pivot connector 12 with a fixing member 16 to secure the supporting bar 14 at a specific angle. The frame member 11 can be a fixed unit or it can be a retractable unit. The base frame 11 is provided with eight coupling units 18 respectively at the opposite sides of the second base bars for installing the elastic cords 191 of the cord assembly 19, i.e. eight coupling units are respectively mounted on left and right sides of the front and rear sides of the base frame. Each of the coupling units 18 has a U-shaped seat member 181 disposed on the second base bar of the base frame 11 which pivots a pulley 182 at top side thereof. The coupling unit 18 can simply be a ring for the passing of the elastic cord 191. The pulleys 182 of the present embodiment are to reduce the friction when pulling the elastic cords 191.

The elastic cords 191 of the cord assembly 19 run through the coupling units 18 at the second base bars of the front side and the back side thereof respectively, please refer to FIG. 2, each elastic cord 191 ties a knot at an end thereof to be stopped at the coupling unit 18 at the second base bars of the back side, the other end thereof runs through the coupling unit 18 at the second base bars of the front side which provides a stop member 192 for preventing it being drawn back and a connector 193 to couple a holding device 194. In practice, the physical training machine of the preferred embodiment of the present can install four elastic cords 191 to change the loading they provided.

Figure 3:
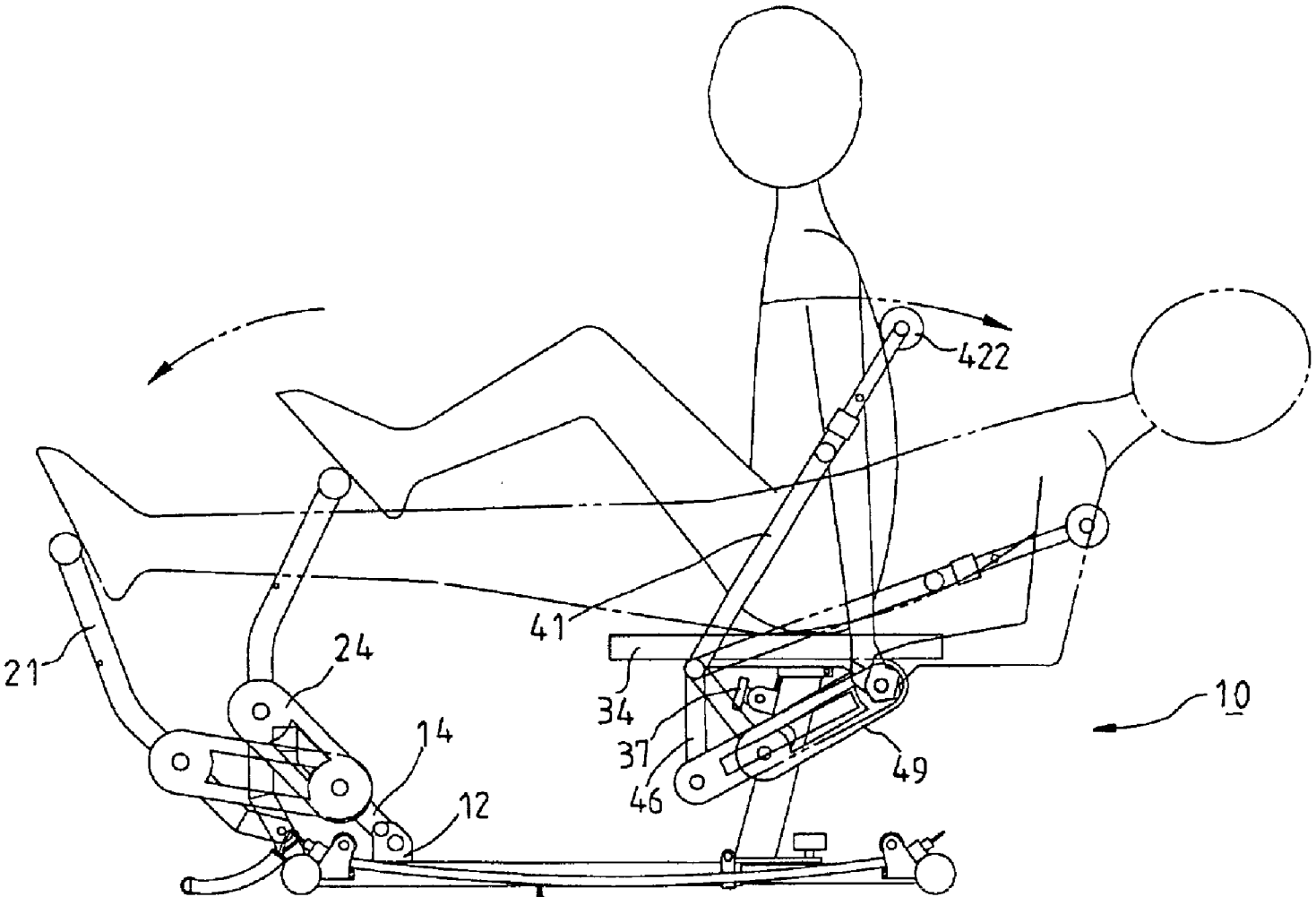
FIG. 3 to FIG. 10 show a user doing exercise on the multi-function training machine of the preferred embodiment of the present invention in various exercise modes.
Figure 6:
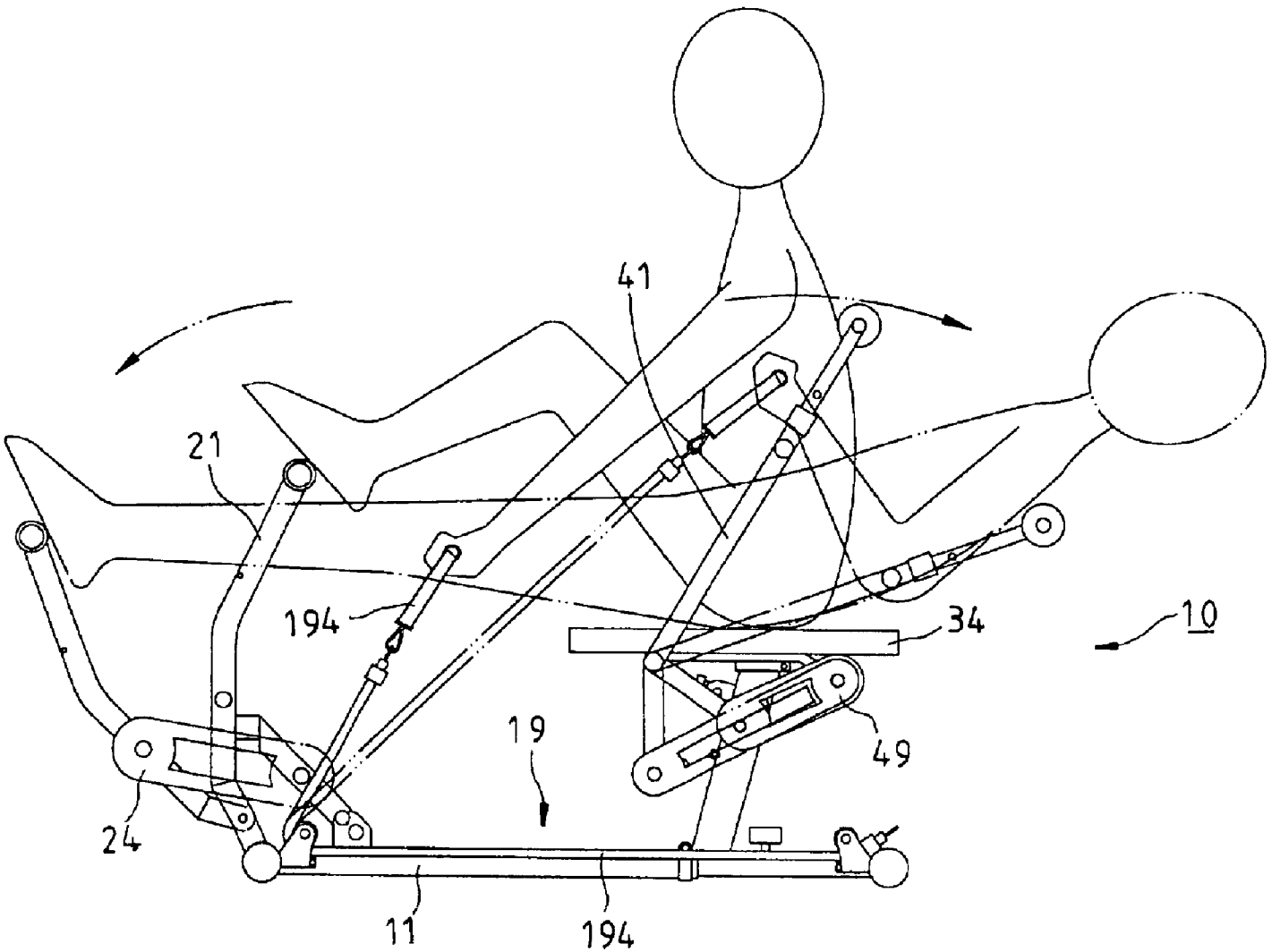

The T-shaped bar 21 is provided with two second transverse bars 22 at two sides of the upright bar respectively. The T-shaped bar 21 pivots its distal end of the upright bar on the front end of the base frame 11. Two resistance members 24 are respectively connected the second transverse bars 22 of the T-shaped bar 21 with the first transverse bars 141 of the supporting bar 14 to be turned by user as shown in FIG. 3 and FIG. 6. The resistance members 24 are rubber pieces to provide the loading when user turns the T-shaped bar 21. User can install more rubber pieces or can take out the rubber pieces to change the loading. The supporting bar 14 will stop the T-shaped bar 21 being turned backwards.

The seat assembly 31 is composed of a seat base 32 and a pad member 34, wherein the seat base 32 pivots the pad member 34 at an end thereof and is fixed with a connecting board 36 at the other end thereof. The connecting board 36 has a joint 361 at an end thereof pivoted on the base frame 11 for movement between a folded position (seeing FIG. 12), at which the seat base 32 rests on the base frame 11 and a extended position (seeing FIG. 1), at which the seat base 32 stands upright. The connecting board 36 has an opening 362 at the other side to insert a locking device 363 therein to secure the seat base 32 at the extended position. The pad member 34 can be turned relative to the seat base 32 and a locking device 37 is to detachable fix the pad member 34 with the seat base 32 to make the pad member 34 can not be turned. The seat base 32 is provided with a first side shaft 38 and a side tube 39 at under side of the pad member 34.

The training bar assembly 41 is composed of an L-shaped first shaft 42 and an L-shaped second shaft 44. The first shaft 42 is provided with a soft pad 422 at its transverse section 421 and openings 424 at its vertical section 423. The vertical section 423 of the first shaft 42 is sleeved into a vertical section 441 of the second shaft 44 such that the total length of the training bar assembly 41 can be changed. The vertical section 441 of the second shaft 44 is provided with a pin 442 to be inserted into one of the openings 424 on the first shaft 42 for securing the first shaft 42 and the second shaft 44 in a specific length. The distal end of a transverse section 443 of the second shaft 44 is pivotally engaged to the side tube 39 on the seat base 32. The transverse section 443 of the second shaft 44 is provided with a connecting bar 46 and a second side shaft 48 closing to the distal end of the connecting bar 46. A resistance member 49 (like the elements labeled 24 as described above) is connected to the first side shaft 38 of the seat base 32 and the second side shaft 48 on the second shaft 44 to provide the loading of the training bar assembly 41.

Next, it will be shown how a user does exercises on the physical training machine 10 of the present invention.

Please refer to FIG. 3 first, user can sit on the pad member 34 and rest his/her back on the soft pad 422 on the training bar assembly 41. He/she faces the T-shaped bar 21 and put his/her feet on the T-shaped bar 21 to push it forwards. The resistance members 24 and 49 of the T-shaped bar 21 and the training bar assembly 41 will give a loading to training user's leg muscles and back muscles.

Figure 4:
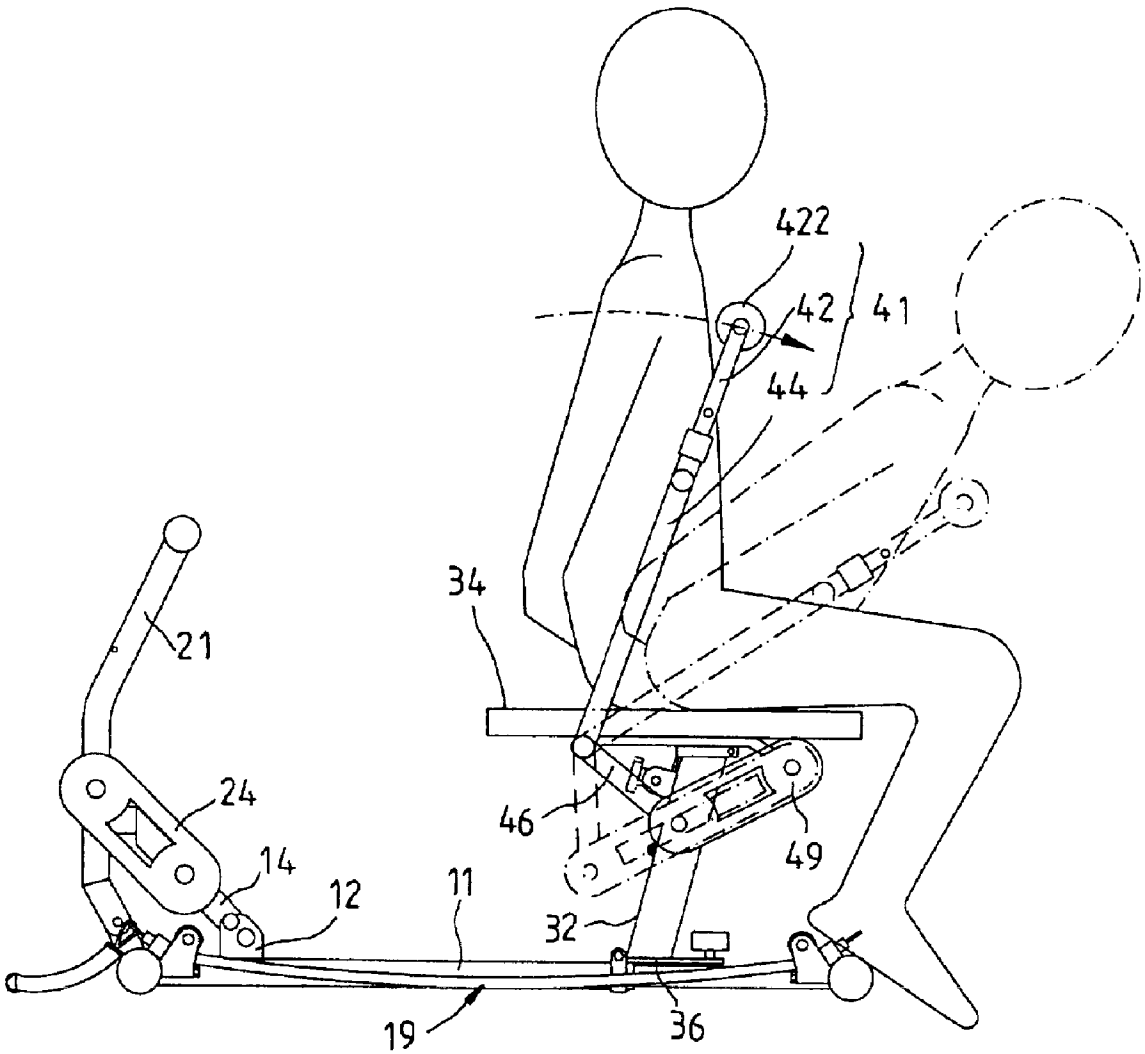

FIG. 4 shows a second exercise mode of the physical training machine 10 of the present invention. User sits on the pad member 34, faces the training bar assembly 41 and rests his/her chest against the soft pad 422 on the training bar assembly 41. Now user can bend and extend the trunk repeatedly for driving the training bar assembly 41 to turn to training the abdominal muscles and back muscles.

FIG. 5 to FIG. 10 show how a user use the cord assembly 19 to train muscles.

Figure 5:
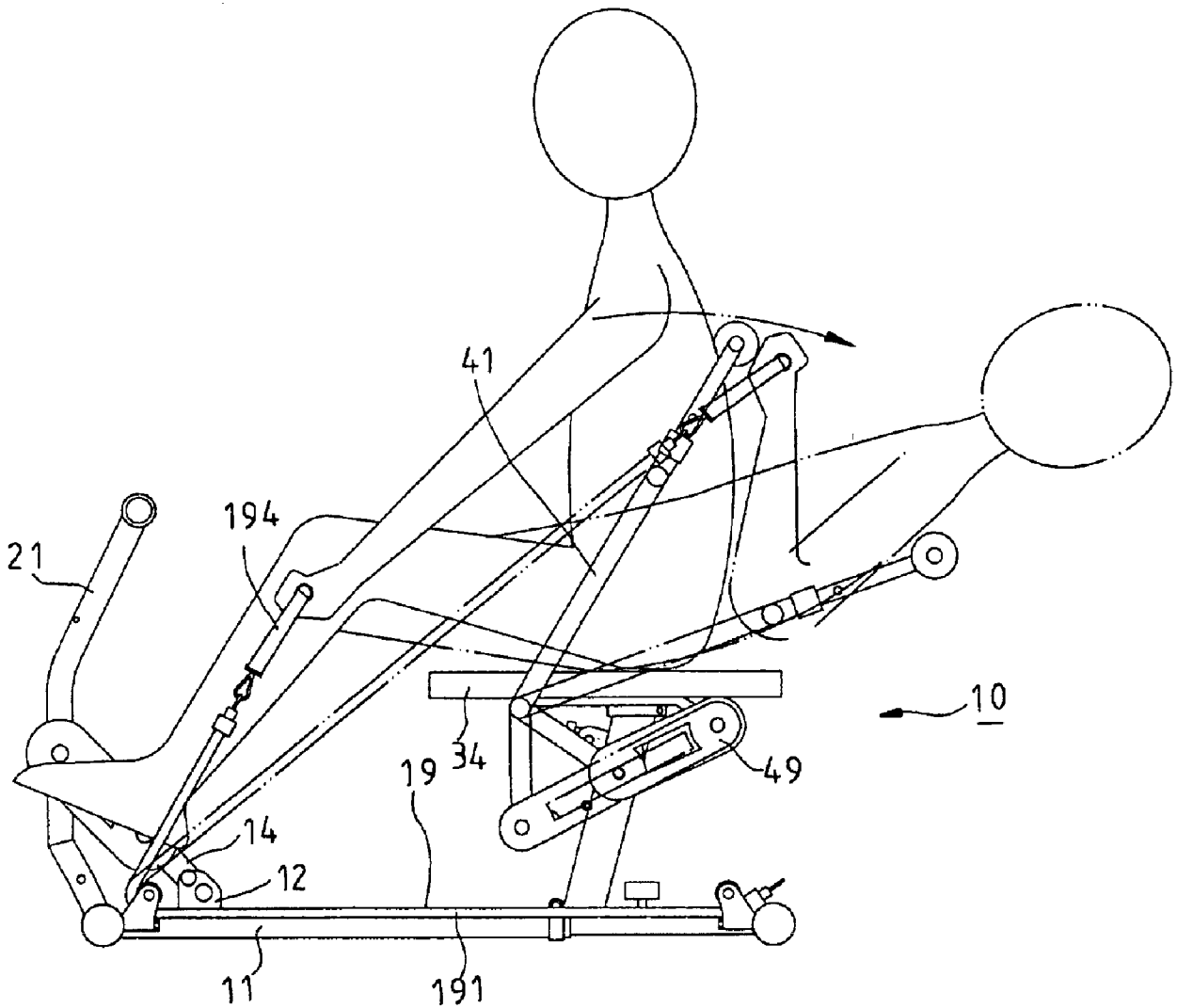

FIG. 5 shows a user sits on the pad member 34, put his/her feet on the first transverse bar 141 and hold the holding devices 194 of the cord assembly 19 by hands. User now can extend the trunk backwards to train the abdominal muscles, back muscles and arm muscles.

FIG. 6 shows another exercise mode of the physical training machine 10 of the present invention similar to the exercise mode shown in FIG. 5. User feet rest against the T-shaped bar 21 to extend his/her trunk and legs in the same time. This is a higher difficulty degree exercise.

Figure 7:
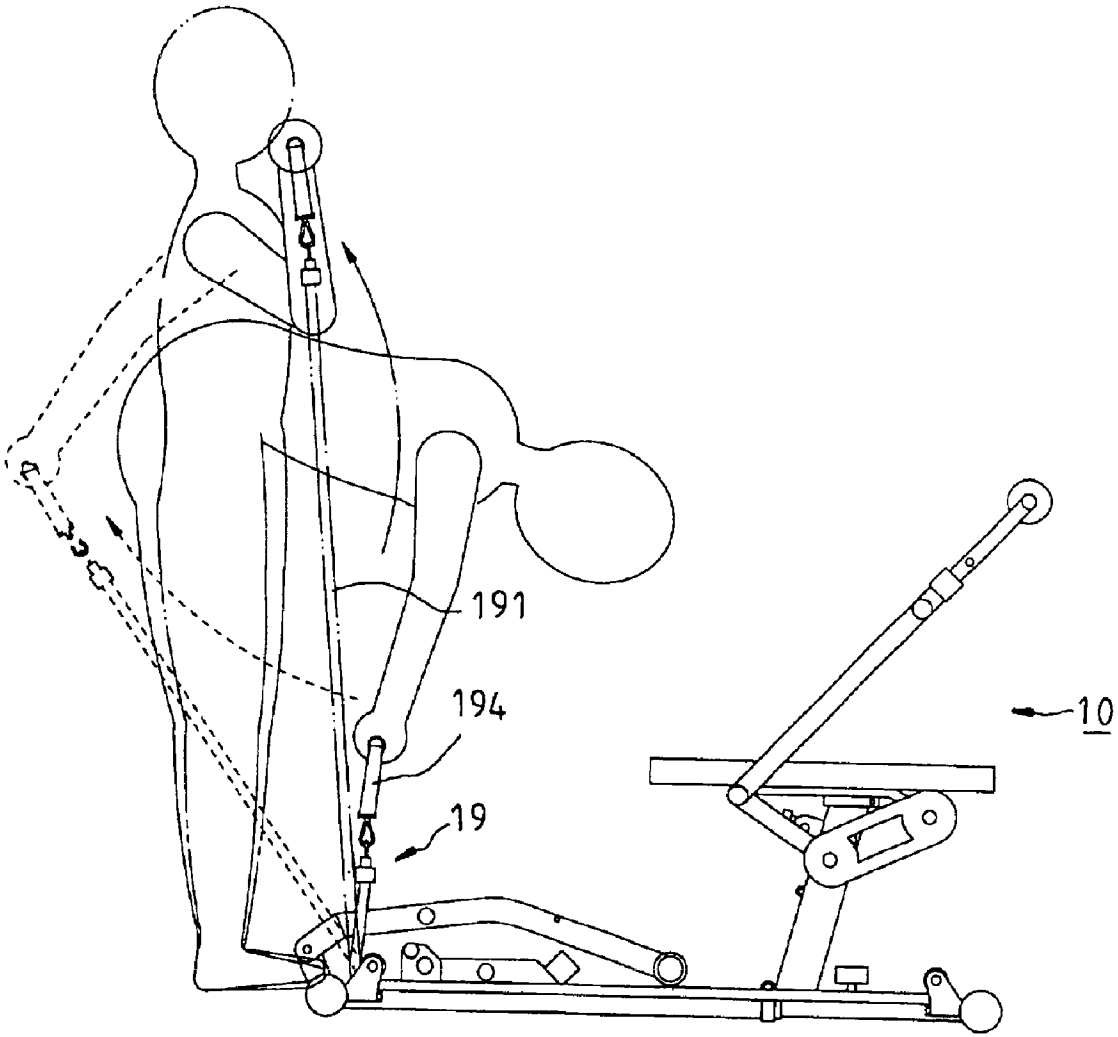

Please refer to FIG. 7, user also can stand beside the physical training machine 10, bend his/her trunk forwards and hold the holding devices 194 of the cord assembly 19 by hands. Extend the trunk and flex the arms to train back muscles and arm muscles. Furthermore, user can raise the arms upwards to do a heavier exercise.

Figure 8:
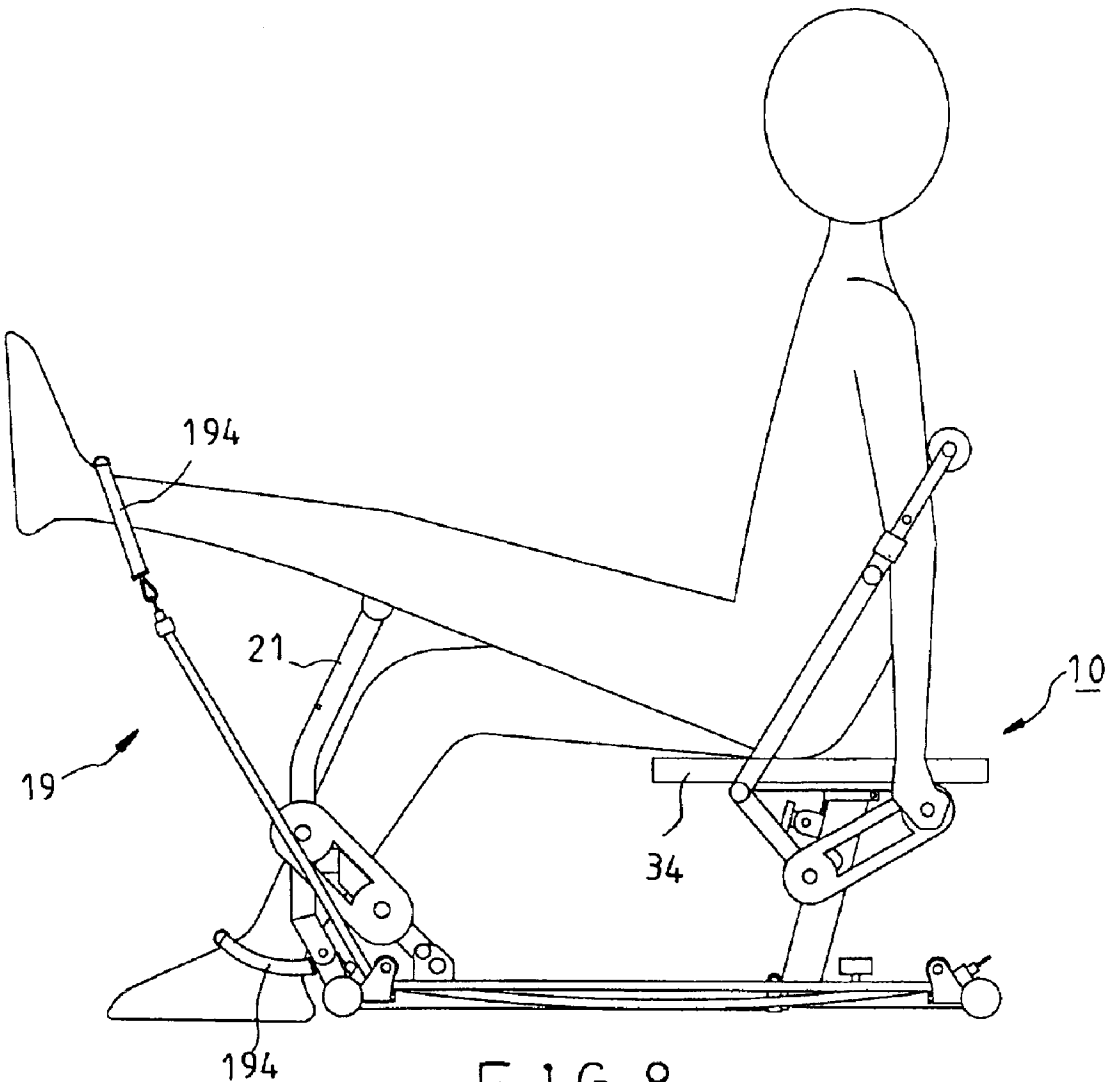

FIG. 8 shows an exercise of training legs. User sits on the pad member 34 to hook the holding devices 194 of the cord assembly 19 by feet. Thus, user can lift the feet repeatedly to train leg muscles.

Figure 9:
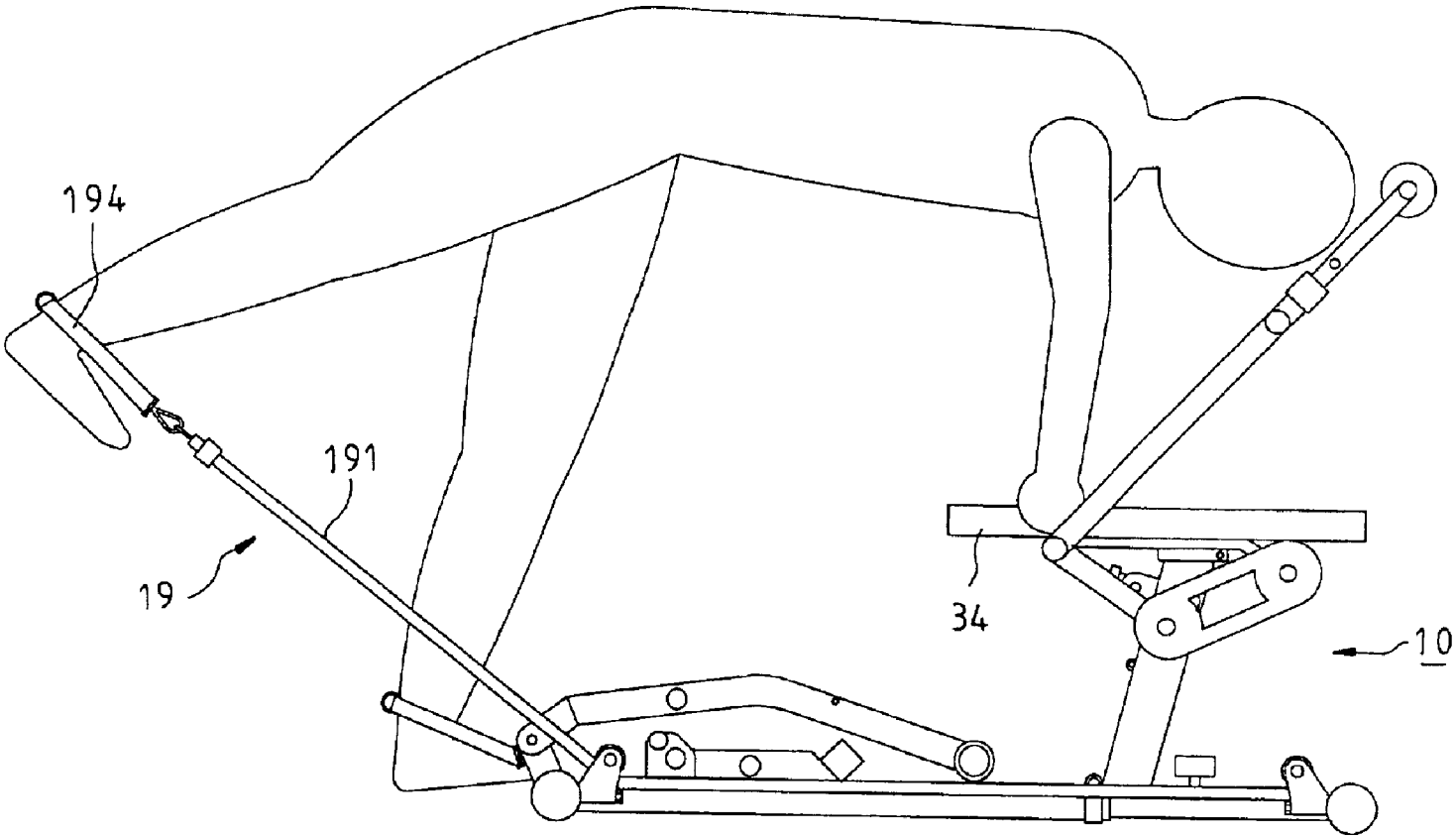

FIG. 9 shows a user standing beside the physical training machine 10 and resting the hand on the pad member 34 with his feet pulling the elastic cords 191 upwards.

Figure 10:
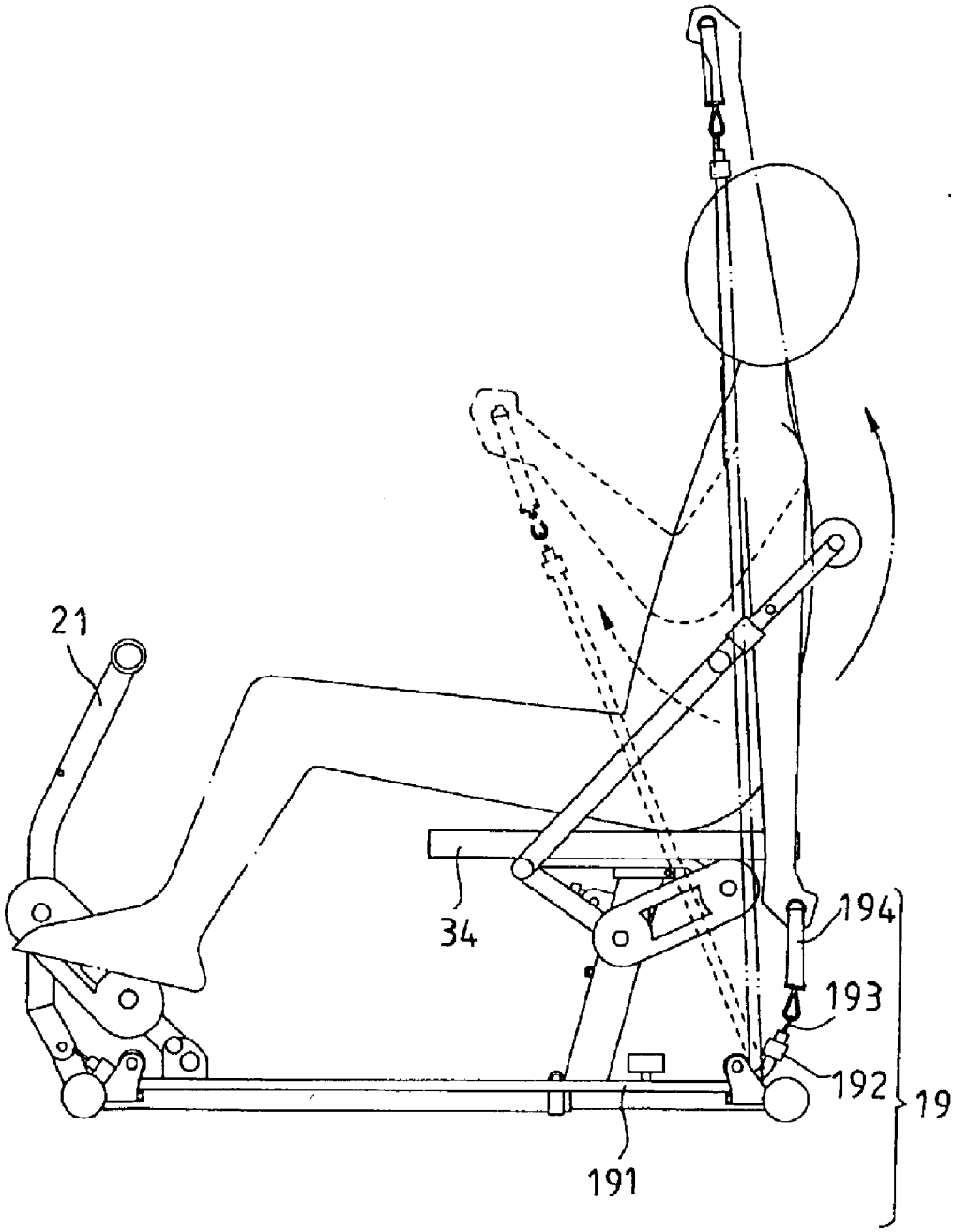

The holding devices 194 are changed to the opposite side closing to the pad member 34 as shown in FIG. 10. User can sit on the pad member 34 and hold the holding devices 194 to raise his/her arms upwards for training the arm muscle. User can raise the arms in various modes such as raise the arms over head, flex the forearms and other raise modes.

Figure 11:
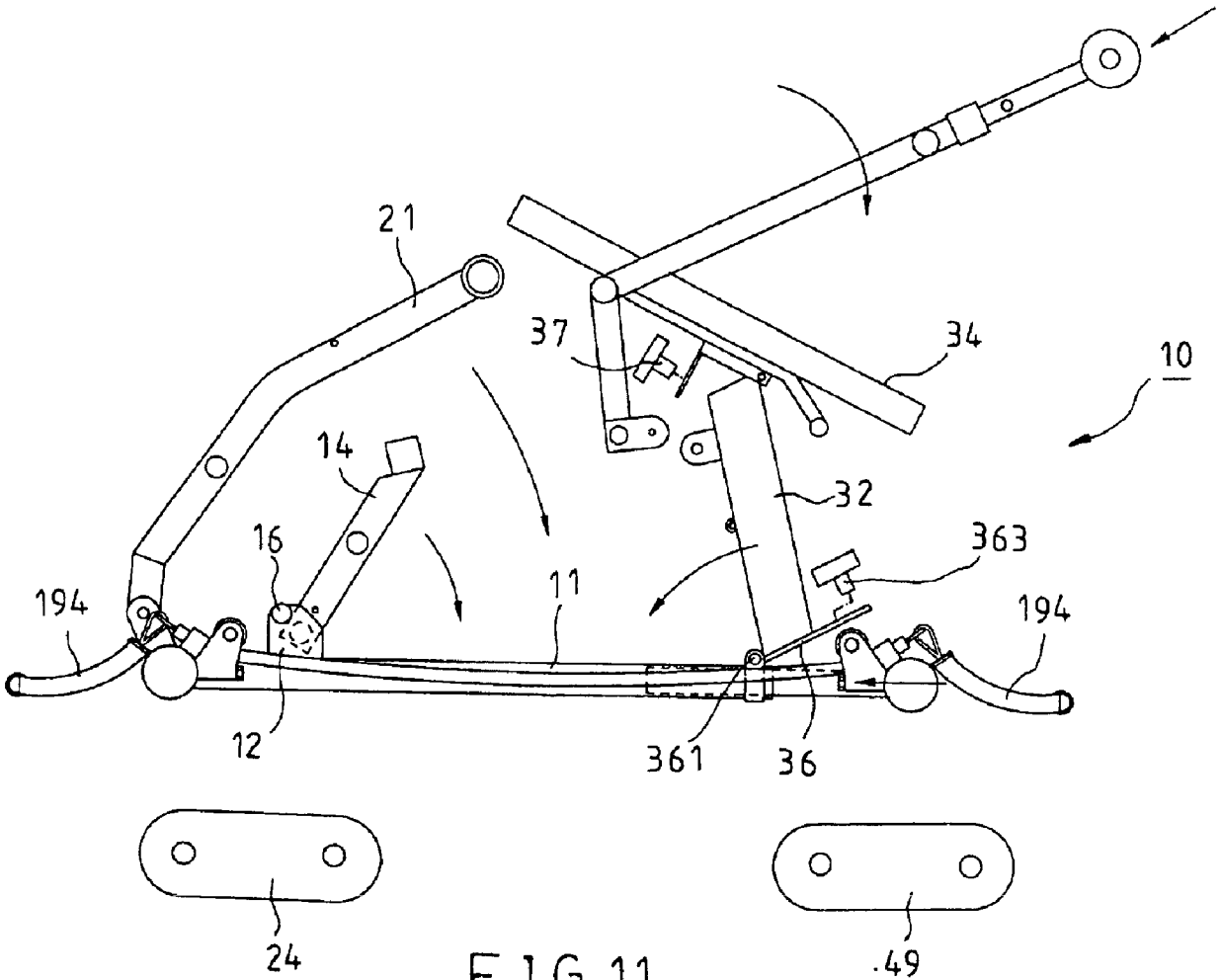
FIG. 11 is a plane view, showing the training machine of the preferred embodiment of the present invention disassembled, and FIG. 12 a plane view, showing the training machine of the preferred embodiment of the present invention folded.
Figure 12:
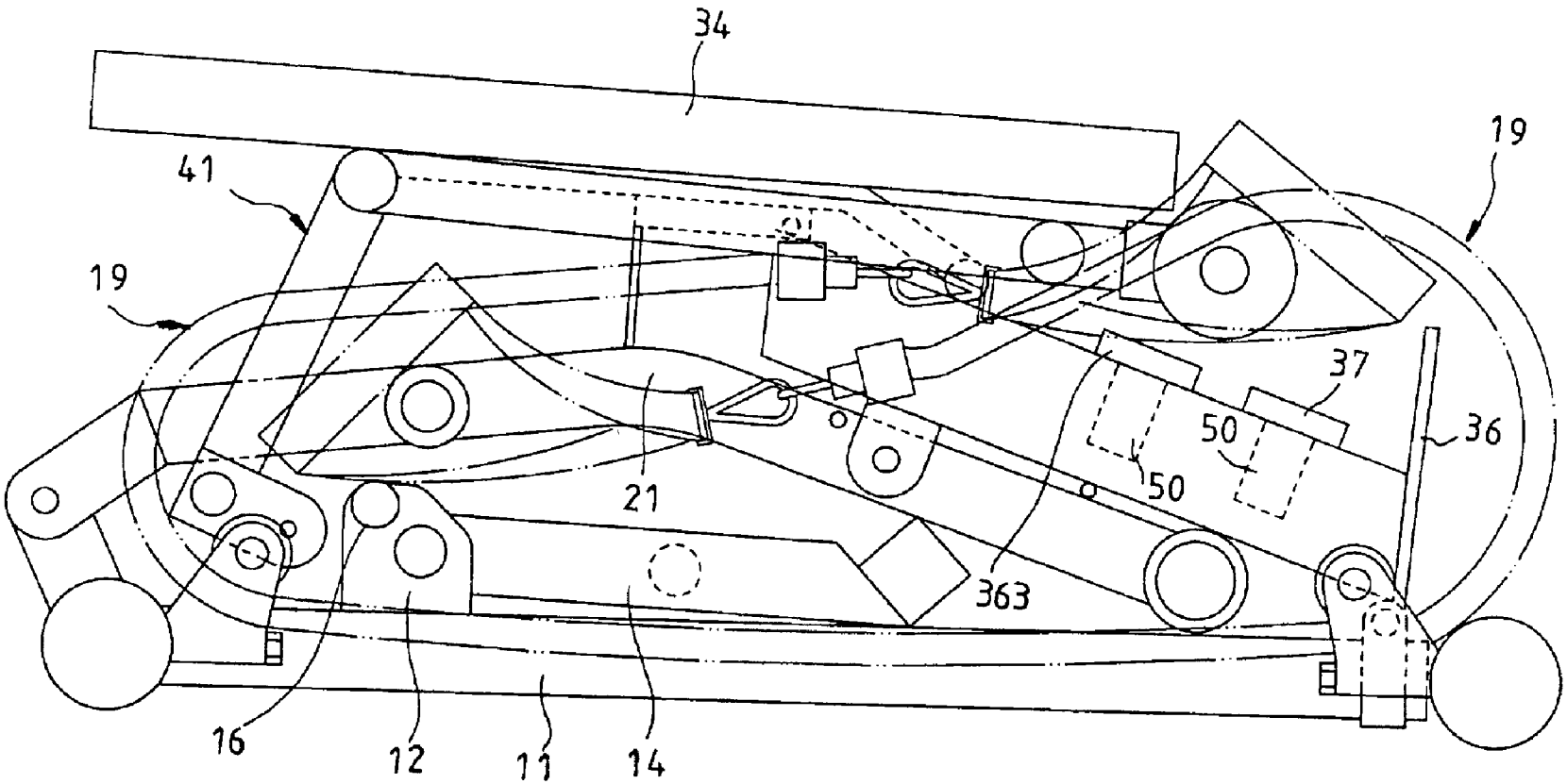

The elastic cord 191 can provide two holding devices 194 at both ends thereof as shown in FIG. 11 and FIG. 12.

FIGS. 11 and 12 show the way of disassembling the physical training machine 10. First, disassemble the resistance members 24 and 49, and then pull the fixing member 16 out of the supporting bar 14 to turn the supporting bar 14 downwards to rest it on the base frame 11 and insert the fixing member 16 back to the supporting bar 14. Next, turn the T-shaped bar 21 downwards, and then pull the locking device 37 out to turn the seat base 32 downwards, in the meantime, the seat pad 34 will be folded. Hang the holding devices 194 of the cord assembly 19 on any bar of the training machine 10, and then the training machine 10 of the present invention will be folded as shown in FIG. 12. The seat base 32 is provided with slots 50 to store the locking devices 363 and 37. In fact, the slots 50 can be disposed on any element of the training machine 10 of the present invention.

What is claimed is:

1. A multi-function physical training machine, comprising:

a base frame having a front side and a rear side;

a supporting bar pivotally mounted on the front side of the base frame;

a plurality of coupling units respectively mounted on left and right sides of the front and rear sides of the base frame;

at least a cord assembly having two elastic cords installed on said coupling units respectively and two holding devices respectively connected to said elastic cords;

a T-shaped bar pivoted on said base frame in front of the supporting bar to be turned in a predetermined range;

at least a first resistance member installed on said T-shaped bar to provide said T-shaped bar a loading when it is turned;

a seat assembly having a seat base provided at an end thereof with a connecting board pivoted on the base frame, a pad member mounted on the other end of the seat base, and a side tube mounted on the seat base below the pad member;

a training bar assembly having a first shaft and a second shaft engaged with said first shaft, wherein said second shaft is engaged with said side tube on said seat base for said training bar assembly can be turned in a predetermined range and said second shaft is provided with a connecting shaft, and at least a second resistance member installed on said training bar assembly to provide said training bar assembly a loading when being turned.

2. The multi-function physical training machine as defined in claim 1, wherein said coupling unit has a U-shaped seat member fixed on said base frame and a pulley pivoted on said seat member.

3. The multi-function physical training machine as defined in claim 1, wherein said resistance member is an elastic rubber piece.

* * * * *